US010184318B2

(12) United States Patent
Nichols

(10) Patent No.: US 10,184,318 B2
(45) Date of Patent: Jan. 22, 2019

(54) DOWNHOLE COMMUNICATION VALVE AND METHOD OF USE

(71) Applicant: COLT PETROLEUM TECHNOLOGY, LLC, The Woodlands, TX (US)

(72) Inventor: Mark B. Nichols, Mineral Wells, TX (US)

(73) Assignee: COLT PETROLEUM TECHNOLOGY, LLC, The Woodlands, TX (US)

( * ) Notice: Subject to any disclaimer, the term of this patent is extended or adjusted under 35 U.S.C. 154(b) by 169 days.

(21) Appl. No.: 15/225,928

(22) Filed: Aug. 2, 2016

(65) Prior Publication Data

US 2017/0037704 A1 Feb. 9, 2017

Related U.S. Application Data

(60) Provisional application No. 62/201,391, filed on Aug. 5, 2015.

(51) Int. Cl.
*E21B 34/14* (2006.01)
*E21B 34/10* (2006.01)

(52) U.S. Cl.
CPC ..... *E21B 34/10* (2013.01)

(58) Field of Classification Search
CPC .... E21B 34/085; E21B 34/102; E21B 34/108; E21B 34/125; E21B 34/12; E21B 2034/007; E21B 34/14
USPC ..... 166/334.4, 332.1
See application file for complete search history.

(56) References Cited

U.S. PATENT DOCUMENTS

| | | | | |
|---|---|---|---|---|
| 5,865,254 | A * | 2/1999 | Huber | E21B 34/063 166/126 |
| 6,079,496 | A * | 6/2000 | Hirth | E21B 21/10 166/321 |
| 6,742,595 | B2 | 6/2004 | Dennistoun et al. | |
| 7,681,665 | B2 | 3/2010 | Eppink | |
| 8,267,178 | B1 * | 9/2012 | Sommers | E21B 34/102 166/334.4 |
| 8,931,565 | B2 * | 1/2015 | Desranleau | E21B 34/14 166/320 |
| 9,476,282 | B2 * | 10/2016 | Anton | E21B 34/063 |
| 9,670,750 | B2 * | 6/2017 | Chauffe | E21B 34/10 |
| 2003/0024704 | A1 | 2/2003 | Hirsch et al. | |
| 2011/0308817 | A1 * | 12/2011 | Ravensbergen | E21B 34/102 166/382 |
| 2013/0043032 | A1 | 2/2013 | Crowley et al. | |

FOREIGN PATENT DOCUMENTS

EP 1024245 A2 8/2000

OTHER PUBLICATIONS

International Search Report and Written Opinion dated Nov. 17, 2016 for Application No. PCT/US2016/045761.

* cited by examiner

*Primary Examiner* — Kenneth L Thompson
(74) *Attorney, Agent, or Firm* — Patterson & Sheridan, LLP

(57) ABSTRACT

A downhole communication valve containing a piston and chamber which allows hyrdrostatic testing of a casing or tubing string multiple times before permanently opening communication ports to the exterior.

20 Claims, 2 Drawing Sheets

DOWNHOLE COMMUNICATION VALVE AND METHOD OF USE

FIELD OF THE INVENTION

The present invention generally relates to drilling and related equipment as typically used in the oil and gas industry. More specifically, the present invention relates to a valve that may be installed within a casing or tubing string and its method of use.

BACKGROUND OF THE INVENTION

A valve which provides flow ports between the internal and external portions that are selectively isolated until a successful integrity test of the casing or tubing string is completed. Hydrostatic pressure applied to the internal portion of the tool causes shifting of an internal piston which compresses gasses until a limit is reached which permanently opens the valve.

Said valve may be conversely used in any application in which hyrodstatic pressure is the preferred or only available method of opening a valve.

DETAIL DESCRIPTIONS OF THE INVENTION

All illustrations of the drawings are for the purpose of describing selected versions of the present invention and are not intended to limit the scope of the present invention.

Figure 1:
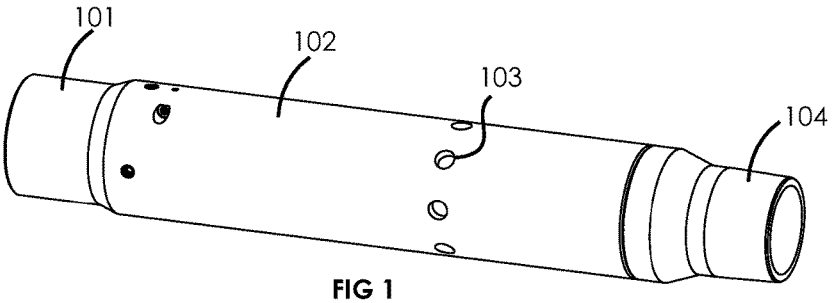
FIG. 1 is an elevated view of a multi-cycle communication valve in accordance with a preferred embodiment.
Figure 2:
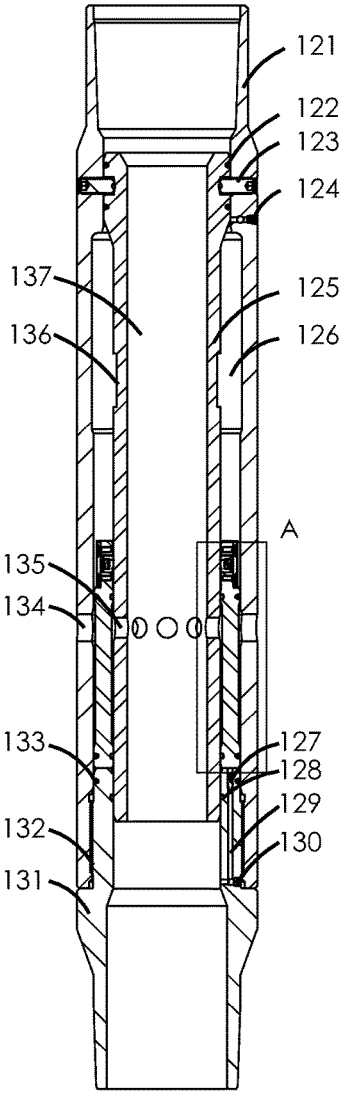
FIG. 2 is a section view of a closed multi-cycle communication valve in accordance with a preferred embodiment.
Figure 3:
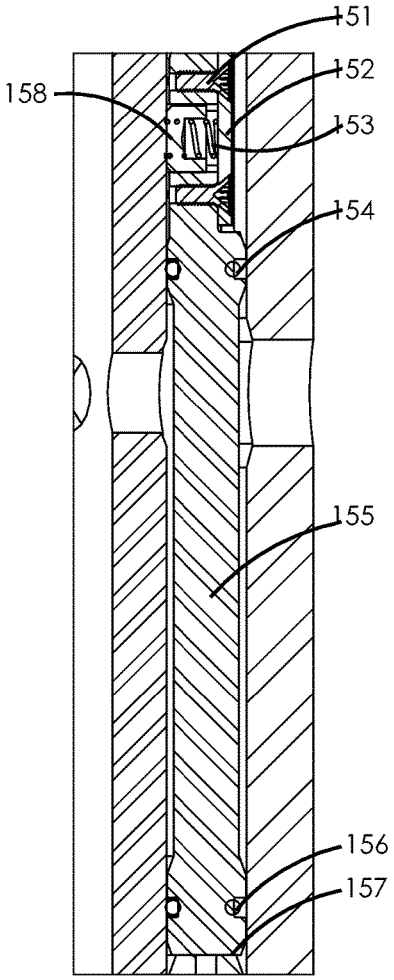
FIG. 3 is a detail view of the portion designated as "A" of FIG. 2.
Figure 4:
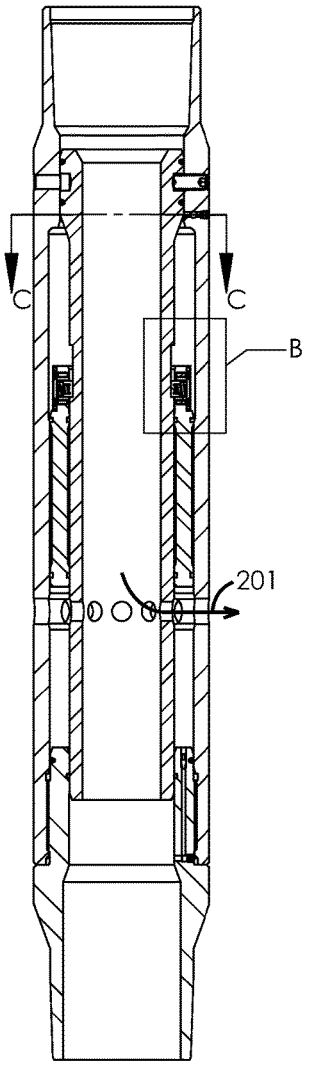
FIG. 4 is a section view of an opened and locked multi-cycle communication valve in accordance with a preferred embodiment.
Figure 6:
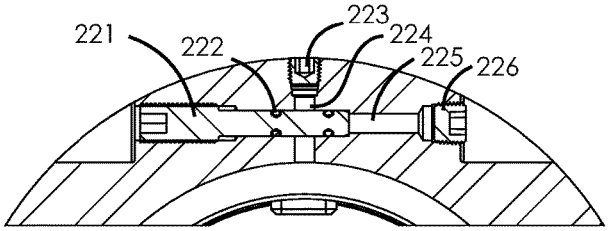
FIG. 6 is a detail view of a filling apparatus in the closed position as shown along the line "C-C" of FIG. 4.
Figure 7:
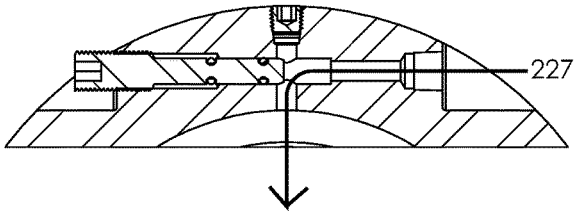
FIG. 7 is a detail view of a filling apparatus in the filling position as shown along the line "C-C" of FIG. 4.
Figure 5:
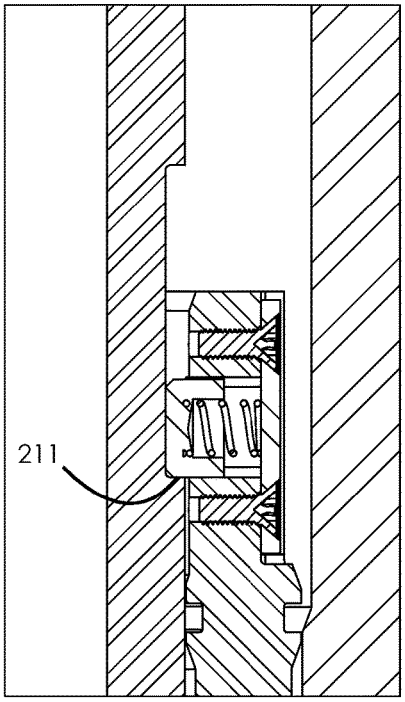
FIG. 5 is a detail view of the portion designated as "B" of FIG. 4.

Referring to FIGS. 1-7 there is provided a multi-cycle communication valve in accordance with a preferred embodiment. As used herein, the terms "a" or "an" shall mean one or more than one. The term "plurality" shall mean two or more than two. The term "another" is defined as a second or more. The terms "including" and/or "having" are open ended (e.g. comprising). The term "or" as used herein is to be interpreted as inclusive meaning one or any combination. Terms such as "upper" and "lower" are in reference to respective positions within the drawings and do not necessarily denote a physical configuration or orientation. Reference herein to "one embodiment", "certain embodiments", "an embodiment" or similar terms means that a particular feature or characteristic described in connection with the embodiment is included in at least one embodiment of the present disclosure. Thus the appearances of such phrases in various places throughout this specification are not necessarily all referring to the same embodiment. Furthermore, the particular features or characteristics may be combined in any suitable manner on one or more embodiments without limitation.

Generally in a preferred embodiment, the multi cycle communication valve is externally comprised of a housing 102, a lower sub 104 which preferably includes a threaded joint for connection to the lower portion of the casing or tubing string, a plurality of flow ports 103 which may be circular, slotted or of any shape to provide adequate flow area and a means of connection to upper portion of the casing or tubing string 101. The multi-cycle communication valve selectively permits fluid transfer to occur between the interior and exterior via the ports 103.

A mandrel 125 is preferably disposed within the bore of the housing 121. Said mandrel may be secured in place with a plurality of screws 123 or by any other acceptable means such as a locking shoulder or a threaded joint. The mandrel preferably provides a bore 137 for the transmission of fluids through the interior to lower portions of the casing or tubing string. The mandrel also preferably provides a plurality of ports 135 which may selectively provide communication between the mandrel's bore 137 and the exterior of the valve via ports provided in the housing 134.

A sleeve 155 is preferentially disposed within the annulus between the mandrel and the housing 121. Upper sleeve seals 154 and mandrel seals 122 create a chamber 126 which may be pre-filled with a gas or liquid via a filling apparatus 124.

An end sub 131 is preferably secured to the housing 121 via a threaded connection 132 thus further restraining the interior components.

Said sleeve 155 may provide a locking feature which is preferably comprised by a plurality of keys 158, springs 153, plates 152 and screws 151. Said spring 153 preferentially is compressed inward by said springs 153. Said spring 153 is kept in compression by the installation of a said cover plate 152 and screws 151. The surface of the mandrel does not allow extension until said key is aligned with a groove in the mandrel 136 thus allowing locking up the keys against a shoulder 211.

The aforementioned filling apparatus 124 may be more generally comprised of intersecting holes 224 and 225, a straight plug 221 with seals 222, a semi-permanent plug 223 and another plug 226. In one configuration, the straight plug 221 is partially withdrawn. Gas or liquid may be filled into the aforementioned chamber 126 via the open passageway 227. Once filling has completed, the straight plug 221 may be inserted such that the seals 222 stop flow from the chamber 126 to the exterior. The plug 226 may be subsequently installed for redundancy.

It will be obvious to one skilled in the art that many such filling arrangements could be used. An alternative is a simple check valve.

Once the chamber 126 is filled to a pre-determined pressure, the sleeve 155 will be forced in the closed direction unless the pressure acting on the sleeve's lower face 157 exceeds the pressure in the chamber 126. If the pressure on the lower face 157 exceeds the pressure in the chamber 126, the sleeve will begin to traverse away from the end sub 131.

A second chamber will be formed by the movement of the sleeve 155. This chamber is defined as the annulus between the mandrel 125 and housing 121 longitudinally constrained between the sleeve 151 and the end sub 131. The chamber is isolated by the end sub seals 133 and 128 and the lower sleeve seals 155. Flow of fluids is permitted into this void or chamber via a series of holes 129. Said holes may be intersecting for manufacturability in which case one or more may be sealed with a plug 130. Flow through these holes is restricted or metered by an insert or orifice 127. The metering of flow controls the speed of the traverse rate of the sleeve 155.

In use, a preferred embodiment of the valve is first assembled and then pre-filled with air or nitrogen as previously described. This pressure may depend on many factors such as well conditions, desired delay time, etc. The valve is then run into the well. To perform a pressure integrity test, pressure on the interior of the casing may be raised to an identified target. This pressure may be held for a period of time before the valve opens. If for any reason, the test is desired to be terminated, the valve may be returned to its original configuration if it has not been fully locked. Therefore, testing may be performed multiple times if desired.

When it is desired to permanently open the valve, a pressure is applied to the interior of the casing or tubing. This pressure is identified by a variety of means but is typically less than the previously mentioned test pressure. If this pressure is held for a sufficient period of time, the valve will first open where the sleeve 155 traverses such that the mandrel ports 135 and the housing ports 134 allow communication with the exterior. The sleeve may then be closed if pressure is relieved or if pressure is maintained, the valve may be placed in the locked position as previously described. If placed in the locked position, the sleeve will permanently allow communication between the ports and thus between the exterior and the interior.

Although the invention has been explained in relation to its preferred embodiment, it is to be understood that many other possible modifications and variations can be made without departing from the spirit and scope of the invention.

I claim:

1. A downhole valve comprising:

a. a tubular housing;

b. a tubular mandrel connected to the tubular housing and defining an interior volume therebetween;

c. a sleeve movably disposed in the interior volume, the sleeve having a first end and a second end;

d. a locking apparatus configured to secure the sleeve in an open, locked position;

e. a sealed chamber defined in the interior volume adjacent to the first end of the sleeve;

f. a pressure medium disposed in the sealed chamber; and g. one or more orifices disposed in one or more holes in fluid communication with the interior volume adjacent to the second end of the sleeve.

2. The downhole valve of claim 1, wherein the sealed chamber is filled with a compressible gas.

3. The downhole valve of claim 1, wherein the sleeve is selectively moveable between a closed position and an open position.

4. The downhole valve of claim 1, wherein the sleeve is moveable between:

a. a closed position wherein fluid communication is not permitted between a central bore and an exterior of the valve;

b. a test position wherein fluid communication is not permitted between the central bore and the exterior of the valve; and c. an open, locked position, wherein fluid communication is permanently permitted between the central bore and the exterior of the valve.

5. The downhole valve of claim 3, wherein the sleeve has a travel path between a closed position, an open, locked position, and a test position between the closed position and the open locked position.

6. The downhole valve of claim 5, wherein the sleeve is movable in either direction between the closed position and the test position.

7. The downhole valve of claim 6, wherein the sleeve is movable between the closed position and the test position, the direction of movement being determined by a pressure differential between the first end and second end of the sleeve.

8. The downhole valve of claim 1, wherein the locking apparatus is connected to the first end of the sleeve.

9. The downhole valve of claim 8, wherein the locking apparatus comprises a spring loaded key.

10. The downhole valve of claim 9, wherein the mandrel comprises a shoulder to receive the spring loaded key.

11. A downhole valve comprising:

a. a tubular housing;

b. a tubular mandrel connected to the tubular housing and defining an interior volume therebetween;

c. a sleeve movably disposed in the interior volume, the sleeve having a first end and a second end;

d. a locking apparatus configured to secure the sleeve in an open, locked position;

e. a sealed chamber defined in the interior volume adjacent to the first end of the sleeve;

f. a filling apparatus in fluid communication with the sealed chamber;

g. a compressible gas disposed in the sealed chamber; and h. one or more orifices disposed in one or more holes in fluid communication with the interior volume adjacent to the second end of the sleeve.

12. The downhole valve of claim 11, wherein the filling apparatus comprises one or holes and a removable plug.

13. The downhole valve of claim 11, wherein the sleeve is moveable between:

a. a closed position wherein fluid communication is not permitted between a central bore and an exterior of the valve;

b. a test position wherein fluid communication is not permitted between the central bore and the exterior of the valve; and c. an open, locked position wherein fluid communication is permanently permitted between the central bore and the exterior of the valve.

14. The downhole valve of claim 11, wherein the sleeve is selectively moveable between a closed position and an open position.

15. The downhole valve of claim 14, wherein the sleeve has a travel path between a closed position, an open, locked position, and a test position between the closed position and the open, locked position.

16. The downhole valve of claim 15, wherein the sleeve is movable in either direction between the closed position and the test position.

17. The downhole valve of claim 16, wherein the sleeve is movable between the closed position and the test position, the direction of movement being determined by a pressure differential between the first end and second end of the sleeve.

18. The downhole valve of claim 11, wherein the locking apparatus is connected to the first end of the sleeve.

19. The downhole valve of claim 18, wherein the locking apparatus comprises a spring loaded key.

20. The downhole valve of claim 19, wherein the mandrel comprises a shoulder to receive the spring loaded key.

* * * * *